US007446311B1

(12) United States Patent
Zare et al.

(10) Patent No.: US 7,446,311 B1
(45) Date of Patent: Nov. 4, 2008

(54) METHOD OF COATING AN ELECTROSPRAY EMITTER

(75) Inventors: Richard N. Zare, Stanford, CA (US); Oliver Trapp, Muelheim an der Ruhr (DE)

(73) Assignee: The Board of Trustees of the Leland Stanford Junior University, Palo Alto, CA (US)

( * ) Notice: Subject to any disclaimer, the term of this patent is extended or adjusted under 35 U.S.C. 154(b) by 254 days.

(21) Appl. No.: 11/332,782

(22) Filed: Jan. 12, 2006

Related U.S. Application Data

(60) Provisional application No. 60/650,943, filed on Feb. 7, 2005.

(51) Int. Cl.
*B01D 59/44* (2006.01)

(52) U.S. Cl. ..... 250/288; 250/282; 250/281

(58) Field of Classification Search ..... 250/281–300
See application file for complete search history.

(56) References Cited

U.S. PATENT DOCUMENTS 7,007,710 B2 * 3/2006 Heller et al. ..... 137/15.01
2003/0141392 A1 7/2003 Nilsson et al. ..... 239/690
2004/0245463 A1 12/2004 Wood et al. ..... 250/307
2007/0252083 A1 * 11/2007 Arscott et al. ..... 250/288

OTHER PUBLICATIONS

Barnidge, D. R., Nilsson, S., Markides, K. E., Rapp, H., Hjort, K., Rapid Commun. Mass Spectrom. 1999, 13, 994-1002.

* cited by examiner

*Primary Examiner*—Jack I. Berman
*Assistant Examiner*—Andrew Smyth
(74) *Attorney, Agent, or Firm*—Lumen Patent Firm, Inc.

(57) ABSTRACT

The present invention provides a method of coating an electrospray emitter with silver and then gold utilizing wet-coating processes. First, the electrospray emitter is immersed in a silver-containing liquid solution to coat the electrospray emitter in a layer of silver. Next, the silver-coated electrospray emitter is removed from the silver solution and rinsed with water. The silver-coated electrospray emitter is then annealed to stabilize the silver layer. Once the silver layer has been stabilized, the silver-coated electrospray emitter is immersed into a gold-containing liquid solution and a voltage is applied. This voltage serves to electrochemically deposit a gold layer onto the silver layer. The gold- and silver-coated electrospray emitter is then removed from the gold-containing liquid solution and rinsed with water and, preferably, with nitric acid.

11 Claims, 7 Drawing Sheets

METHOD OF COATING AN ELECTROSPRAY EMITTER

CROSS-REFERENCE TO RELATED APPLICATIONS

This application claims priority from U.S. Provisional Application No. 60/650,943, filed Feb. 7, 2005 which is incorporated herein by reference.

STATEMENT REGARDING FEDERALLY SPONSORED RESEARCH OR DEVELOPMENT

This invention was supported in part by the Air Force Office of scientific research (AFOSR) under the contract/grant No. FA9550-04-1-0076. The Government has certain rights in this invention.

FIELD OF THE INVENTION

The present invention relates generally to metal coating processes and procedures. More particularly, the present invention relates to coating procedures for electrospray emitters.

BACKGROUND

Electrospray emitters are commonly used to transfer analytes emerging from capillary or chip format separation techniques into charged species for mass analysis. Thus, electrospray emitters have found use in capillary electrophoresis (CE), capillary electrochromatography (CEC), open capillary electrochromatography (o-CEC), and nanoscale liquid chromatography (nano-LC). Sheathless electrospray and nanospray emitters meet the demands for high sensitivities, low flow rates, and reduced peak broadening effects on separations, whereas widely used and very robust sheath-flow interfaces dilute the eluting analytes with additional liquid and therefore cause a decrease in sensitivity at very low flow rates.

Electrospray is achieved by applying a high potential (between 2 and 5 kV) to the spray tip, relative to the orifice of the mass spectrometer, which represents the counter electrode. In sheathless electrospray emitters the electrical potential is applied to a conductive coating on the outside of the spray tip, which is ideally part of the separation capillary so that it does not introduce dead-volumes or flow distortions. The high electric field strength used for electrospray leads to sputtering of the coating, as well as electrochemical reactions at the interface, mainly electrolysis of water in the positive spray mode. The use of sheathless electrospray emitters is therefore limited by short lifetimes that are typically up to 100 h for standard electrospray and 6 h for nanospray. In addition, gas formation caused by solvent oxidation and corrosion of the conductive metal surface can result in mechanical and oxidative stress on the coating.

Several coating procedures have been described in the literature ranging from vapor deposition of noble metals and application of conductive polymers, to gluing gold particles ("Fairy Dust") or graphite ("Black Dust" and "Black Jack") onto fused-silica capillaries. The latter methods produce very stable sheathless electrospray ionization (ESI) emitters with exceptional lifetimes of over 300 h of continuous use.

Thin, smooth metal films facilitate the electrospray process by creating a high surface tension at the very small contact area of the eluent with the electrode. Vapor deposition of metals and their combinations, e.g., silver, gold, titanium, and chromium, onto the spray tip is usually achieved in vacuum. This procedure, however, cannot be applied to very delicate capillary columns modified with monolithic materials or wall coatings as stationary phases, which require storage under a buffer solution or solvent to prevent desiccation. Accordingly, there is a need in the art to develop a metal coating process for producing stable electrospray emitters that is compatible with the delicate capillary columns used for electrospray emitters.

SUMMARY OF THE INVENTION

The present invention provides a method of coating an electrospray emitter with silver and then gold utilizing wet-coating processes. First, the electrospray emitter is immersed in a silver-containing liquid solution to coat the electrospray emitter in a layer of silver. Next, the silver-coated electrospray emitter is removed from the silver solution and rinsed with water. The silver-coated electrospray emitter is then annealed to stabilize the silver layer. Once the silver layer has been stabilized, the silver-coated electrospray emitter is immersed into a gold-containing liquid solution and a voltage is applied. This voltage serves to electrochemically deposit a gold layer onto the silver layer. The gold- and silver-coated electrospray emitter is then removed from the gold-containing liquid solution and rinsed with water and, preferably, with nitric acid.

Any type of electrospray emitter may be coated according the method of this invention. Examples include capillary-based electrospray emitters and those fabricated from microchips. Capillary-based electrospray emitters may be made, e.g., from bare capillaries, capillaries coated with a stationary phase, packed capillaries, or columns packed with a monolithic material. Preferably, the electrospray emitter is made of a silicate material. Examples of silicate materials include fused silica, glass, silicon dioxide, etc.

The present invention also provides electrospray emitters coated with a layer of silver and a layer of gold. These electrospray emitters are preferably mechanically and electrochemically stable for at least about 600 hours. The silver- and gold-coated electrospray emitters may be capillary-based or fabricated from microchips and preferably have a silicate material for a body. Silver- and gold-coated capillary-based electrospray emitters may have bodies that are, e.g., bare capillaries, capillaries coated with a stationary phase, packed capillaries, or columns packed with a monolithic material. Preferably, the silver- and gold-coated electrospray emitters are sheathless.

BRIEF DESCRIPTION OF THE FIGURES

The present invention together with its objectives and advantages will be understood by reading the following description in conjunction with the drawings, in which.

DETAILED DESCRIPTION OF THE INVENTION

Figure 1:
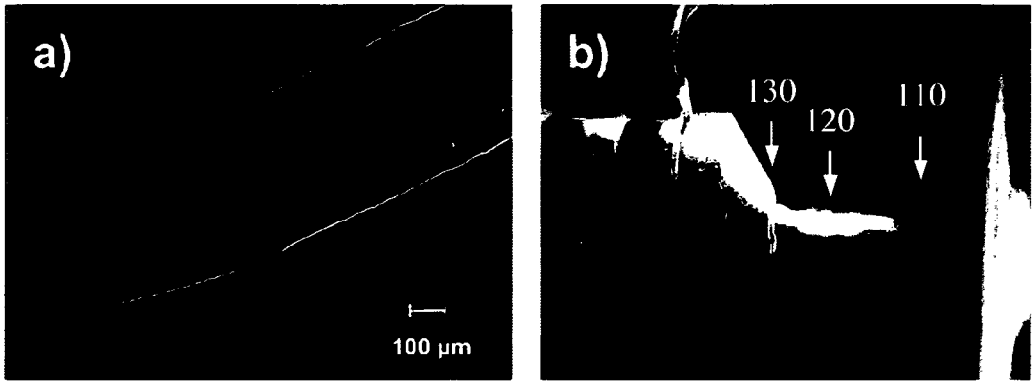
FIG. 1 shows an example of an electrospray emitter according to the present invention.

The present invention provides a method of coating electrospray emitters with silver and then gold using wet coating processes. This process may be used for any type of electrospray emitter, including capillary-based and microchip-based emitters. For capillary-based emitters, the capillary is preferably tapered. Examples of tapering protocols include that developed by Barnidge et al (Bamidge, D. R., Nilsson, S., Markides, K. E., Rapp, H., Hjort, K., *Rapid Commun. Mass Spectrom.* 1999, 13, 994-1002). In addition, the capillary is preferably cleaned prior to coating with gold or silver. This cleansing serves to remove dust, grease, or small particles on the capillary. The cleaning solution may be, e.g., water and methanol or an ammonia/methanol solution.

The silver wet-coating process is based on the silver mirror reaction, in which reduction of a silver amine complex is used to form a stable, metallic conductive coating on glass surfaces. In the inventive method, a silicate electrospray emitter body is immersed in a solution containing a reducing agent and a silver amine complex. Any reducing agent may be used according to the invention, including but not limited to a glucose solution. Similarly, any basic silver amine complex may be used, including but not limited to silver(I)-diammin nitrate. The deposition speed of the silver mirror reaction was optimized for coating of electrospray emitters by adjusting the ratio between the reducing agent and the basic silver amine complex solution; if the reaction ratio is too fast, a very thin and unstable silver layer is formed. Preferably, the molar ratio between the reducing agent and the basic silver amine complex is between about 1:1 to about 2.5:1. Once the silver layer has been deposited on the electrospray emitter, it is removed from the solution and rinsed with water, preferably deionized water. To increase the stability of the silver layer, the silver-coated electrospray emitter is than annealed. Preferably, the annealing takes place at room temperature for at least about 48 hours.

After the electrospray emitter is coated with silver, it is coated with gold using another wet-coating process. The silver-coated electrospray emitter is first immersed into a gold-containing solution and a voltage is applied, resulting in electrochemical deposition of a gold layer on the silver-coated electrospray emitter. Preferably, the gold containing solution is a gold complex solution, including but not limited to a gold(III)-cyanide complex solution. The deposition of gold onto the silver layer requires the application of a controlled electrolytic potential to prevent displacement of silver atoms by gold leading to weakening of the silver primer. In the case of coating with a gold(III)-cyanide complex solution, weakening is facilitated by the fact that three equivalents of silver atoms are displaced by one equivalent of gold atom and that free cyanide ions lower the potential for the oxidation of silver by oxygen. The weakening can be observed by treating a silver-coated capillary with the gold solution without application of an electrolytic potential. Preferably, the voltage applied to the solution is between about −1.5V and about −2.2 V. After the silver-coated electrospray emitter is coated with gold, it is then preferably rinsed with water. In a preferred embodiment, the silver- and gold-coated electrospray emitter is then rinsed with nitric acid. An application of about 65% nitric acid does not affect the silver-gold coating, but removes any uncovered silver. Uncovered silver may be softly removed with diluted nitric acid (about 5%-15%). The gold coating of the electrospray tips may be refreshed at any time by repeating the gold-coating steps described above.

The present invention also provides silver- and gold-coated electrospray emitters made according to the above-described process. Preferably, the silver- and gold-coated electrospray emitters have a layer of silver that is between about 0.1 nm and about 300 μm thick and a layer of gold that is between about 0.1 nm thick and about 500 μm thick. Also preferably, the silver- and gold-coated electrospray emitters are mechanically and electrochemically stable for at least about 600 hours. In addition, the silver- and gold-coated electrospray emitters are preferably sheathless. Any silicate material may be used as the body of the electrospray emitter, including, e.g., fused-silica, glass, and silicon dioxide. In addition, the body may be capillary or microchip-based. Bare capillaries, capillaries coated with a stationary phase (e.g. poly(methacrylate), poly(vinyl alcohol), aminopropyl silane, mercapto propylsilane or an enantioselective stationary phase), packed capillaries (e.g. those packed with silica or functionalized silica), and columns packed with a monolithic material (e.g. organic, inorganic or organic and inorganic sol-gel materials) are all suitable electrospray emitter bodies. The capillaries may be coated with, e.g., polyimide or any other polymer enhancing the flexibility of the capillary.

FIG. 1 shows an example of a silver- and gold-coated electrospray emitter according to the present invention. FIG. 1A shows a scanning electron microscopy (SEM) picture of the silver- and gold-coated tip of a tapered fused silica capillary. The metal surface is relatively smooth and increases the surface tension of the eluent, which improves formation of a stable Taylor cone for the electrospray. FIG. 1B shows a close-up of a silver- and gold-coated sheathless electrospray emitter according to the present invention. The formation of a symmetrical Taylor cone 110 emerging from a very short jet 120 from spray tip 130 is visible.

EXAMPLES

Coating a Fused-Silica Capillary with Silver

Two stock solutions were prepared having the following composition: solution I was 3 g silver nitrate dissolved in 90 mL deionized water; and solution II was 2 g potassium hydroxide dissolved in 90 mL deionized water. 75 mL of solution I were mixed with concentrated ammonia solution, until any formed precipitate was dissolved. Then solution II was slowly added, during which a brown precipitate was formed. This mixture was carefully titrated with concentrated ammonia solution until everything was dissolved, paying particular attention to avoid excess of free ammonia. Finally, the remaining 15 mL of solution I were added and the resulting solution was filtrated to remove colloidal silver hydroxide. This solution can be stored in a dark bottle in a freezer (−18° C.) for several months without formation of any precipitate.

Prior to the silver coating, the tapered end of a fused-silica capillary was carefully cleaned from grease and dust by rinsing the outer wall with an ammonia/ethanol solution (25 mL concentrated ammonia mixed with 75 mL ethanol) and water to remove ammonia. Then the capillary was dipped into a 15 mL glass vial containing 10 ml of the silver coating solution. To this 5 mL glucose solution (12.5 g dissolved in 200 mL deionized water) were added and carefully mixed. The mixture turned dark immediately, and after approximately 4 min a shiny silver coating was visible at the wall of the glass vial, while the color of the solution changed to yellow. The capillary tip was removed and carefully rinsed with deionized water. Subjecting the silver coating to an annealing process at room temperature for 48 h yielded a very stable film.

Coating a Silver-Coated Fused-Silica Capillary with Gold

A stainless steel wire coil was used to make electrical contact to the silver-coated capillary tip. Then the silver-coated capillary tip was dipped into one side of a U-tube containing a solution of gold(III)-chloride (200 mg), potassium cyanide (200 mg), sodium hydrogenphosphate (6 g), and sodium sulfite (1 g), all of which was dissolved in 100 mL deionized water. On the other side of the U-tube a stainless steel anode was placed. For the deposition of gold, −1.5 V to −2.2 V was applied to the silver-coated capillary with a DC power supply. The current should not exceed 0.9 mA, and formation of hydrogen bubbles should be avoided. The electrolytic current allows the control of the thickness of the gold film (0.6804 mg/C). After 5 minutes, the white-silver color changed to yellow-gold because of the deposited gold layer. The capillary was removed from the U-tube and rinsed with water to remove traces of cyanide.

Long-Term Fatigue Test of Silver- and Gold-Coated Electrospray Emitters

Figure 2:
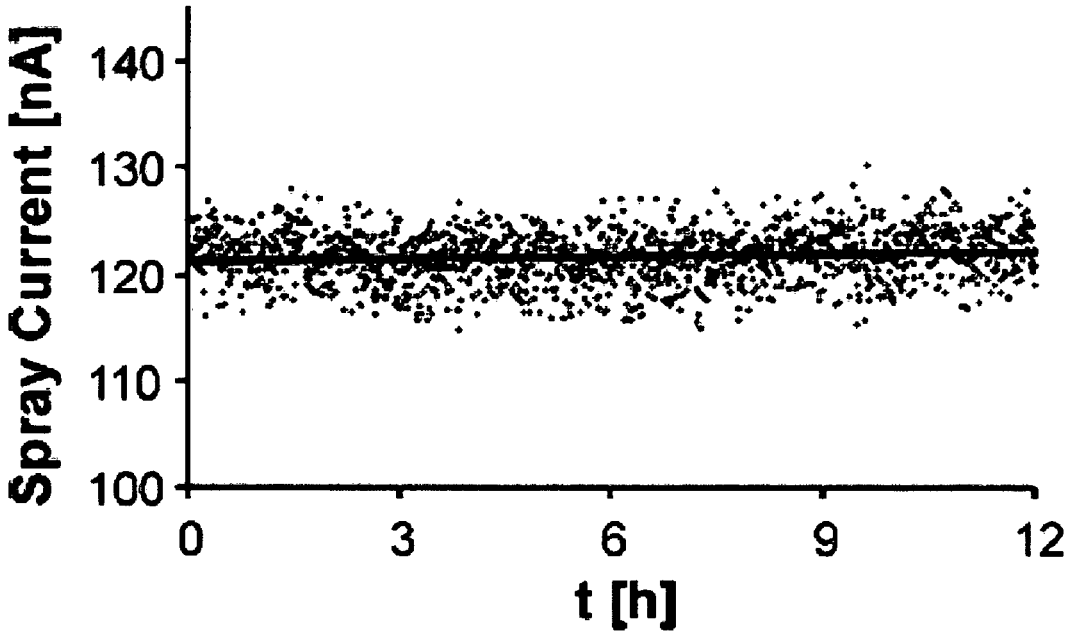
FIG. 2 shows stability of spray current from an electrospray emitter according to the present invention.

To evaluate the long-term stability of silver- and gold-coated shaped fused-silica electrospray emitters, several capillaries (length 1 m, ID 50 μm, OD 360 μm) were prepared according to the procedures described above and placed into a bench-top electrospray device. A spray voltage of +2.5 kV was applied to the silver- and gold-coated capillary tip and a solution of 100 mM tetrabutylammonium acetate dissolved in 65 mL deionized water, 5 ml acetic acid, and 30 mL methanol was infused at a rate of 400 mL/min. The spray current was recorded in 0.5 s to 30 s intervals with a picoamperometer at the heated counterelectrode. Heating was necessary to avoid formation of droplets on the counterelectrode, causing change of the electrical field strength. From time to time the spray tip was rinsed with some droplets of buffer to remove dust particles attracted by the high potential. Addition of methylene blue to the buffer solution revealed the formation of a perfect circle (d=4.5 mm) of the sprayed aerosol on the counterelectrode centered to the axis of the electrospray emitter. The spray current was stable at 121.6±2.5 nA for at least 600 h. During this time the coating of the spray tip was observed with a microscope and no changes were visible. FIG. 2 demonstrates the spray stability over a 12 h period (slope=0.08 nA/h). The time period shown is from 336 to 348 hours of continuous operation.

Figure 3:
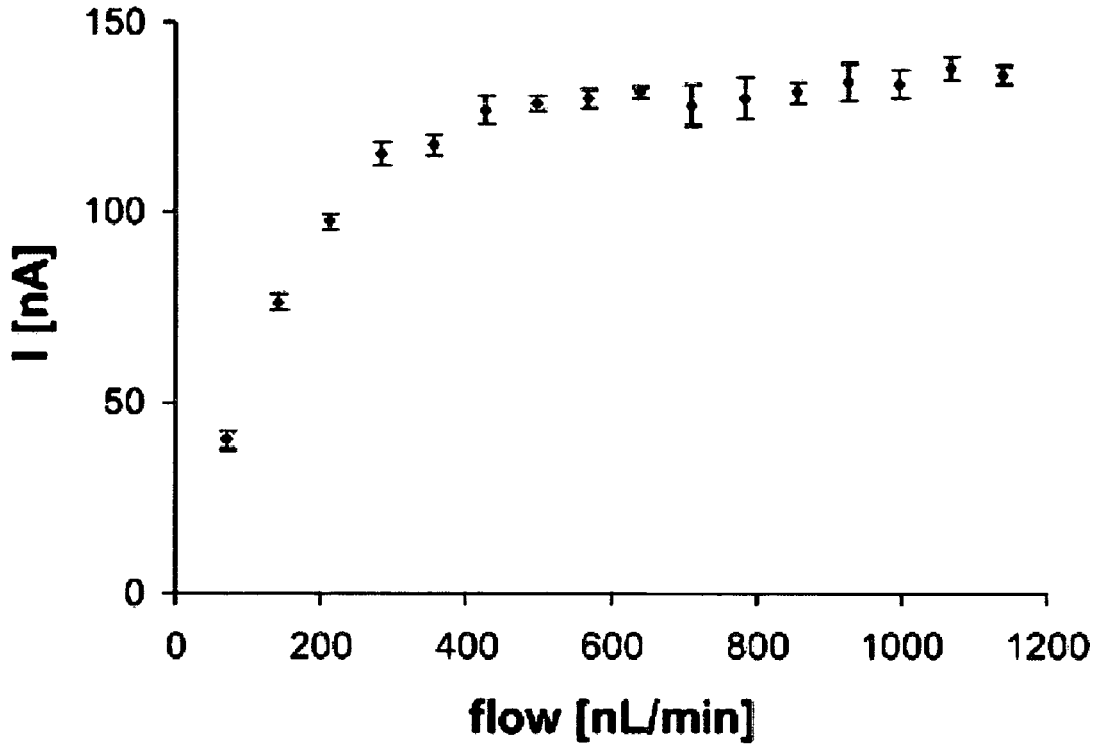
FIG. 3 shows spray current dependence on flow rate for an electrospray emitter according to the present invention.

Evaluation of Spray Current Dependence on Flow Rate for Silver- and Gold-Coated Electrospray Emitters Depending on the flow rate of the infused buffer, stable electrospray conditions were obtained by varying the spray voltage between +2.0 kV and +3.6 kV and the distance of the spray needle to the counterelectrode between 4.0 mm to 12.0 mm. FIG. 3 shows the dependence of the spray current on the flow rate. Even at very low flow rates less than 100 mL/min a stable spray current is obtained. With increasing flow rates the spray current converges to the asymptotic limit of approximately 125 nA.

Use of a Silver- and Gold-Coated Electrospray Emitter for Capillary ELECTROPHORESIS-HADAMARD Transform-Time of Flight-Mass Spectrometry (CE-HE-TOF-MS)

Capillary electrophoresis (CE) in combination with mass spectrometry (MS) is a well-established technique. It is characterized by production of fast and efficient separations and identification of the constituents found in complex sample mixtures. To apply this combination to analyze small volumes of sample requires an MS interface with minimized dead volumes and interruption-free electrical contact to provide a continuous separation and electrospray process. To investigate the performance of a silver- and gold-coated sheathless electrospray emitter according to the present invention, the CE separation was coupled to a Hadamard-transform time-of-flight mass spectrometer (HT-TOF-MS). For the separation and coupling with the MS a poly(vinyl alcohol)-coated fused-silica capillary (1 m, ID 50 μm, OD 360 μm) was tapered and coated with silver and gold as described above. A mixture of nine peptides, angiotensin I human, angiotensin II human, angiotensin II (fragment 3-8), angiotensin III human, bradykinin, gramicidin S, substance P, substance P (fragment 1-4), and substance P (fragment 7-11), was pressure-injected (2 s at 0.5 psi, corresponding to 1.3 mL) and a potential of +28 kV was applied to a buffer vial (1:1 mixture of 50 mM formic acid/ammonium acetate buffer pH 2.8 and methanol). The concentration of each peptide was 22.2 μM, which corresponds to 28 fmol in the injected sample volume. The effective potential across the separation capillary was 24.4 kV because the spray tip was held at +3.6 kV. For data acquisition with the HT-TOF-MS a 10-bit binary pseudo-random sequence with 200 ns time bins (5 MHz) and summation of 10,000 passes was selected.

Figure 4:
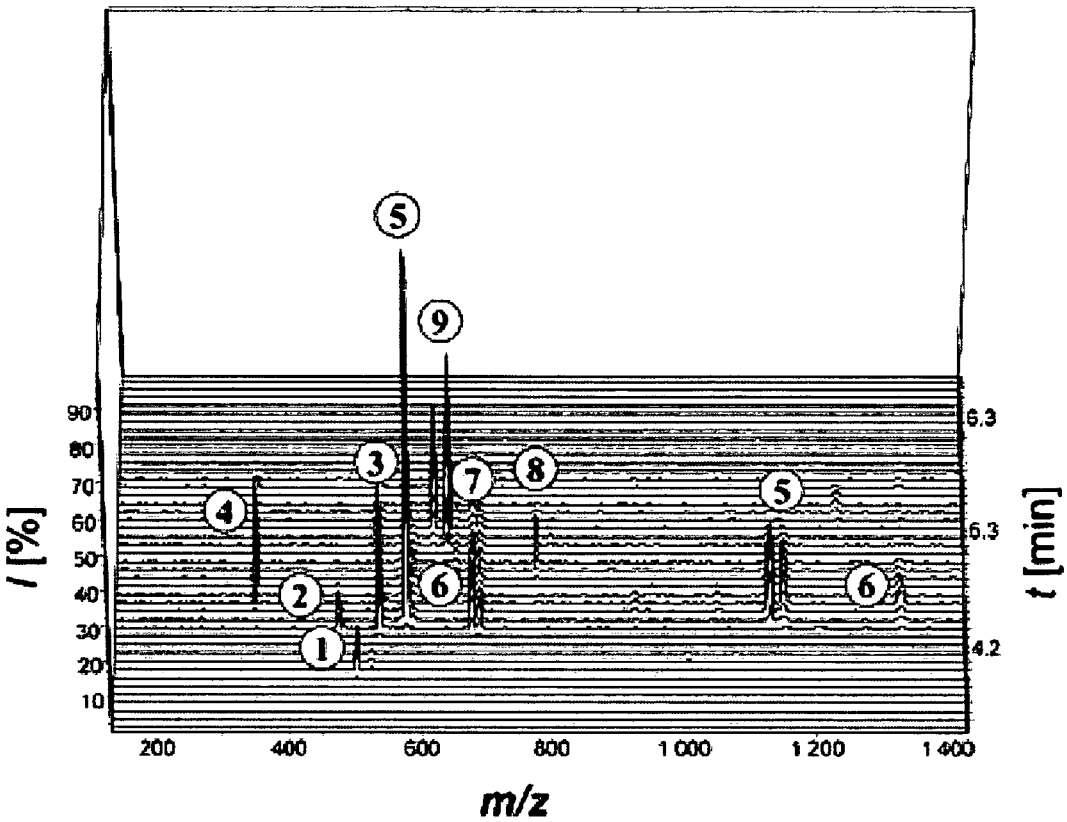
FIG. 4 shows results of a pressure-supported capillary electrophoresis-Hadamard transform-time of flight-mass spectrometry (CE-HT-TOF-MS) experiment using a sheathless electrospray emitter according to the present invention.

The three-dimensional plot in FIG. 4 represents the result of the pressure-supported CE-HT-TOF-MS experiment, with the x-axis representing mass/charge ratio (m/z), the y-axis representing time (minutes), and the z-axis representing the relative intensity (I(%)) of the peak. Depending on the duration of the sample injection and the applied pressure during the separation, an efficiency of between 100,000 and 220,000 theoretical plates N ($N=5.545\cdot(t_R/w_h)^2$; with the migration time $t_R$ and the peak width at half height $w_h$) was achieved (calculated for gramicidin: $t_R$=4.75 min, $w_h$ between 1.4 and 2.1 s). All nine peptides could be separated and identified by their mass spectra and comparison with neat peptides.

Figure 5:
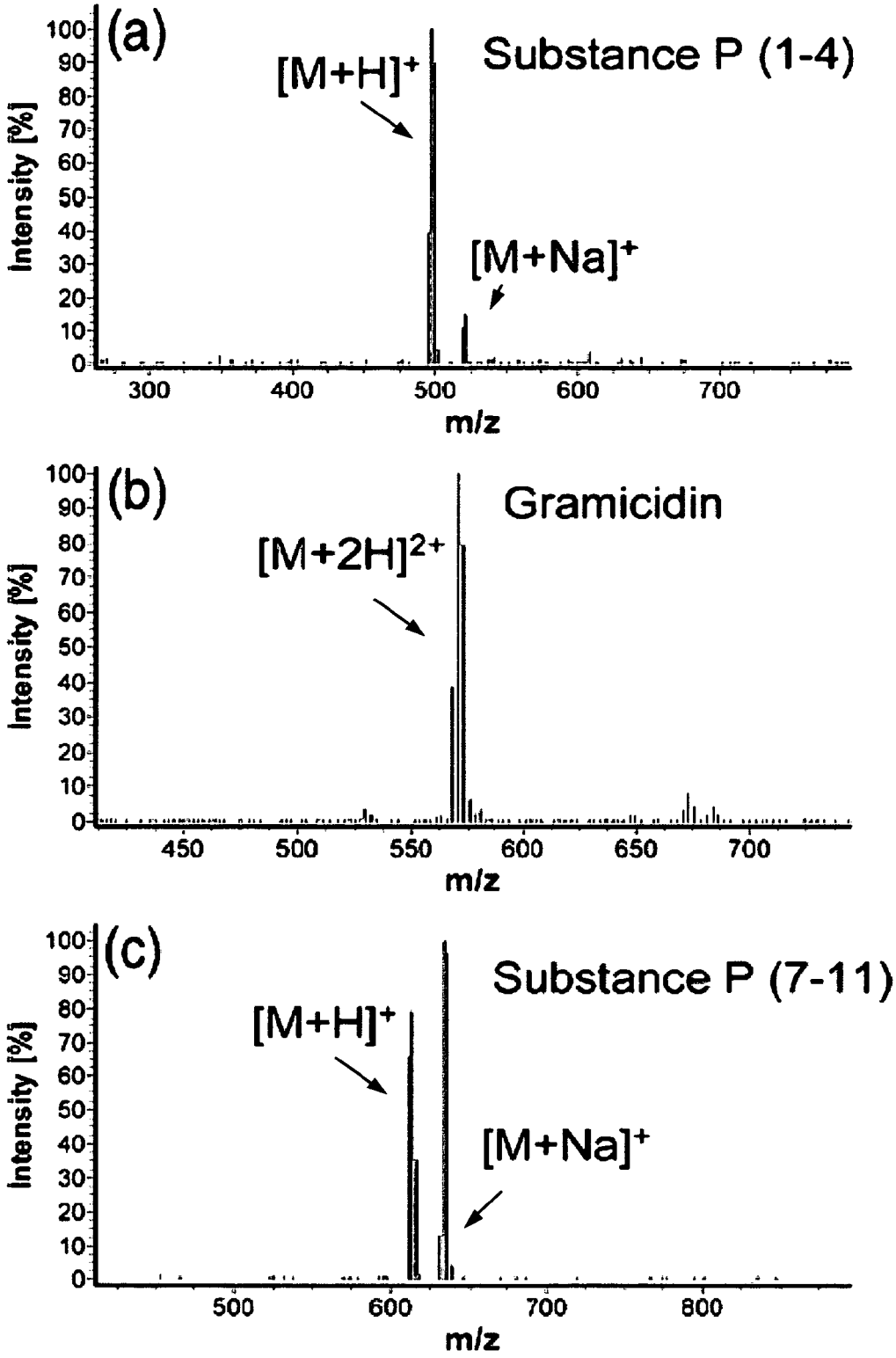
FIG. 5 shows mass spectra obtained from a pressure-supported CE-HT-TOF-MS experiment using a sheathless electrospray emitter according to the present invention.

In FIG. 5 selected mass spectra of substance P (fragment 1-4; RPKP, FIG. 5A), gramicidin S (cyclo-$(VOLFP)_2$ FIG. 5B), and substance P (fragment 7-11; FFGLM-$NH_2$ FIG. 5C) from the CE-HT-TOF-MS experiment are depicted, where the x-axis depicts mass/charge ratio (m/z) and the y-axis depicts relative intensity (I(%)) of the peak. For substance P (fragment 1-4) and substance P (fragment 7-11) sodium adducts $[M+Na]^+$ are present as well as protonated molecules $[M+H]^+$. Only protonated molecules $[M+2H]^{2+}$ are present for gramicidin. It is evident from these mass spectra that a very good signal-to-noise ratio ($SNR_{max}\approx 48$) and sensitivity even for low sample quantities (28 fmol) is achieved with silver- and gold-coated sheathless electrospray emitters according to the present invention.

Coupling of Silver- and Gold-Coated Electrospray Emitters to a Quadrupole Mass Spectrometer The coupling of silver- and gold-coated sheathless electrospray emitters made according to the present invention to a commercial quadrupole mass spectrometer demonstrates the widespread potential application of such devices. For this experiment, a 35 cm capillary (polyimide coated fused silica, 360 μm O.D., 50 μm I.D.) lead from an inlet buffer vial to the x, y, z micropositioner of an ESI source. The metal-coated tip of the capillary was centered on the inlet orifice of the mass spectrometer, and located at a distance of 5-8 mm from the orifice. Samples were injected by a pressure of 1 psi for 1 s. The samples contained a mixture of three peptides (angiotensin II, bradykinin, and methionine-enkephalin) at a concentration of 0.1 mg/mL, in a solution of 5 mM ammonium acetate (pH 4.3) in water. The running buffer for these experiments was 5 mM ammonium acetate (pH 4.3) in water. A separation voltage of 20 kV was applied to the buffer at the inlet buffer vial. When used in conjunction with an electrospray voltage of 2.6 kV, these conditions led to a stable current in the capillary of about 15 μA. Mass spectra for these experiments were recorded on a Finnigan SSQ 7000 single quadrupole mass spectrometer, equipped with an API interface. The heated capillary inlet of the API source was maintained at 200° C. for all measurements. Spectra were acquired at the rate of 2 per second over the mass range from 10 to 700 m/z.

Figure 6:
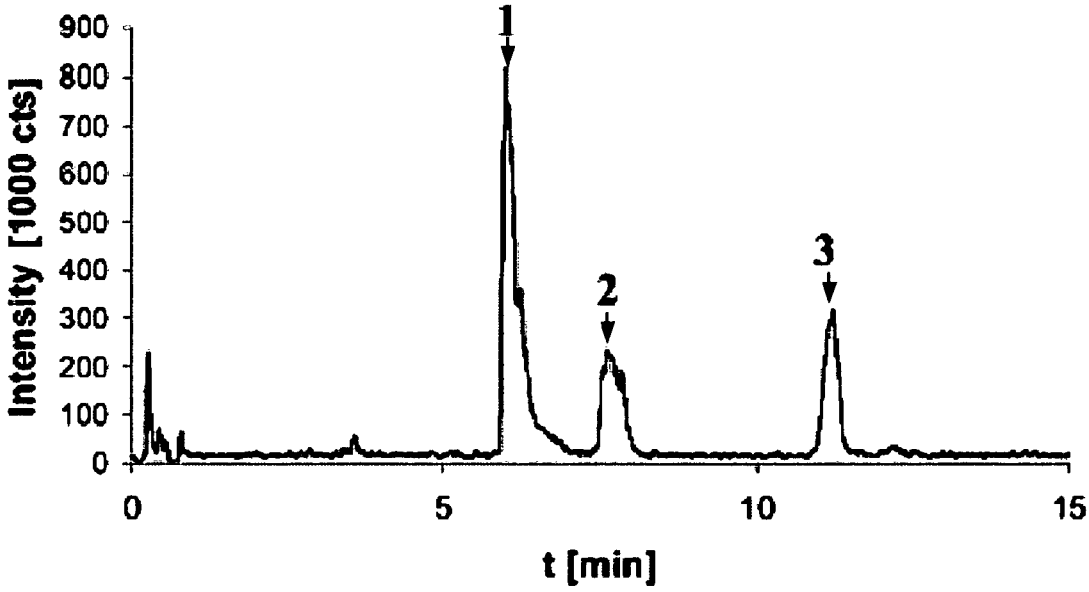
FIG. 6 shows an electropherogram obtained by coupling of a sheathless electrospray emitter according to the present invention to a quadrupole mass spectrometer.
Figure 7:
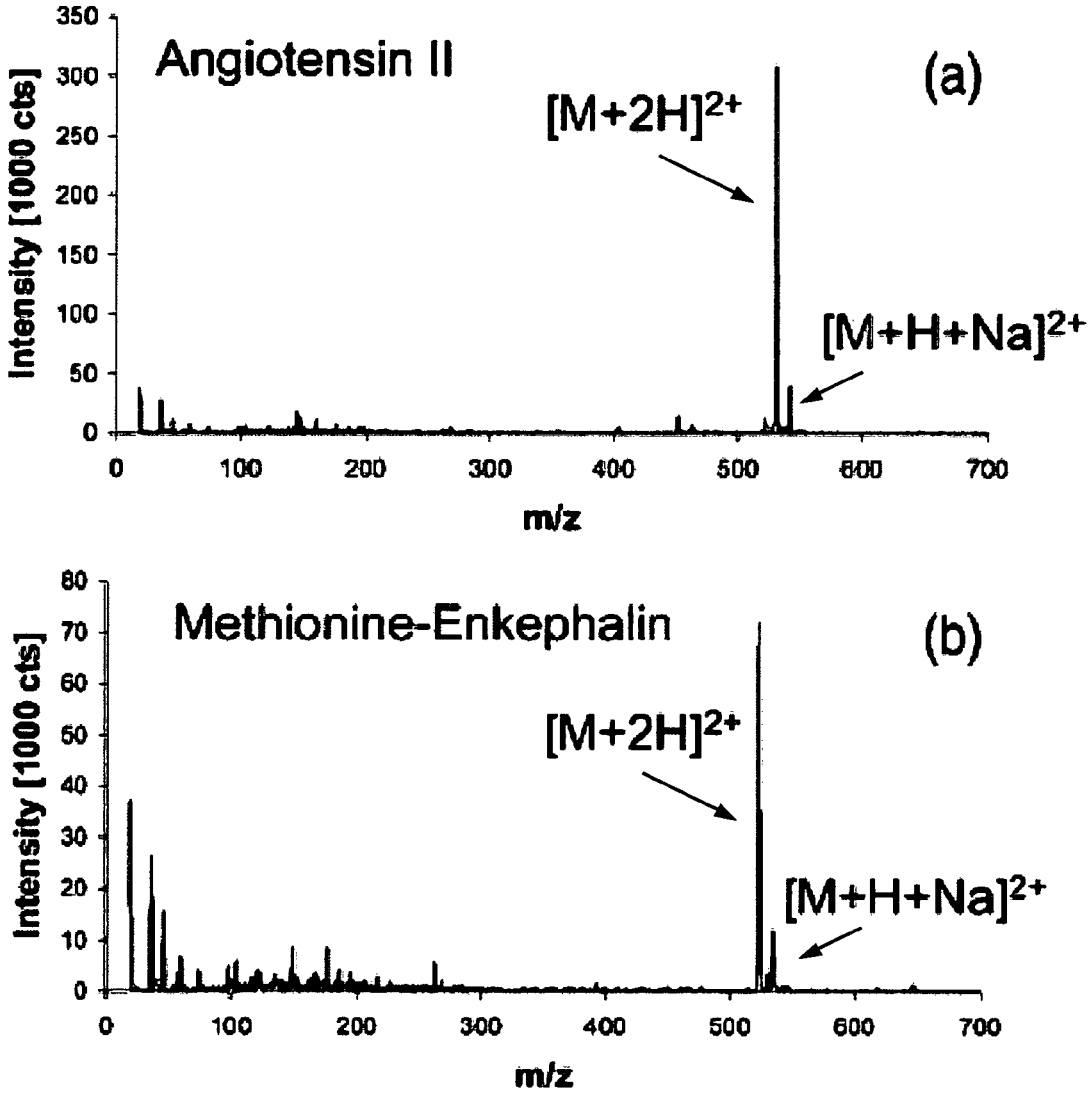
FIG. 7 shows mass spectra obtained by coupling of a sheathless electrospray emitter according to the present invention to a quadrupole mass spectrometer.

When coupled to the quadrupole MS (Q MS) to perform a CE separation, the electrospray emitters demonstrated a high signal-to-noise ratio (SNR) in both the electropherogram (FIG. 6) and the individual spectra taken during each peak (FIG. 7). Most importantly, these emitters were able to maintain the stable electrical connection necessary for electroosmotic flow (EOF), over the course of a large number of separations. No break in current inside the column was observed. FIG. 6 shows the intensity of the peaks for bradykinin (1), angiotensin (2) and methionine-enkephalin (3) versus time. FIG. 7 shows individual mass spectra for angiotensin (A) and methionine-enkephalin (B). Both spectra show sodium adducts $[M+H+Na]^{2+}$ and protonated molecules $[M+2H]^{2+}$.

As one of ordinary skill in the art will appreciate, various changes, substitutions, and alterations could be made or otherwise implemented without departing from the principles of the present invention. Accordingly, the scope of the invention should be determined by the following claims and their legal equivalents.

What is claimed is:

1. A method of coating an electrospray emitter, comprising:

coating said electrospray emitter with a layer of silver using a wet-coating process; and coating said silver-coated electrospray emitter with a layer of gold using a wet-coating process.

2. The method as set forth in claim 1, wherein said electrospray emitter comprises a silicate material.

3. The method as set forth in claim 1, wherein said electrospray emitter comprises a bare capillary, a capillary coated with a stationary phase, a packed capillary, or a column packed with a monolithic material.

4. The method as set forth in claim 1, wherein said silver wet-coating process comprises:

(a) immersing said electrospray emitter in a silver-containing liquid solution to coat said electrospray emitter with a layer of silver;

(b) removing said silver-coated electrospray emitter from said silver-containing solution;

(c) rinsing said silver-coated electrospray emitter with water; and (d) annealing said silver-coated electrospray emitter.

5. The method as set forth in claim 4, wherein said annealing is conducted at room temperature for at least about 48 hours.

6. The method as set forth in claim 4, wherein said silver-containing liquid solution comprises a combination of a glucose solution and a silver amine complex solution.

7. The method as set forth in claim 1, wherein said gold wet-coating process comprises electrochemically depositing said layer of gold onto said silver-coated electrospray emitter.

8. The method as set forth in claim 7, wherein said electrochemical depositing comprises:

(a) immersing said silver-coated electrospray emitter into a gold-containing liquid solution;

(b) applying a voltage to said silver-coated electrospray emitter;

(c) removing said gold and silver-coated electrospray emitter from said gold-containing liquid solution; and (d) rinsing said gold and silver-coated electrospray emitter with water.

9. The method as set forth in claim 8, wherein said voltage is between about −1.5 V to about −2.2 V.

10. The method as set forth in claim 8, wherein said gold-containing liquid solution comprises a gold(III)-cyanide complex solution.

11. The method as set forth in claim 1, further comprising rinsing said gold- and said silver-coated electrospray emitter with nitric acid.

* * * * *